US005437190A

United States Patent [19]

Ehrenpreis et al.

[11] Patent Number: 5,437,190

[45] Date of Patent: Aug. 1, 1995

[54] METHOD FOR DETERMINING THE EFFECTS OF STRESS

[75] Inventors: David B. Ehrenpreis, Fort Lee, N.J.; Walter E. Haisler, College Station, Tex.

[73] Assignee: The United States of America as represented by the Secretary of the Navy, Washington, D.C.

[21] Appl. No.: 706,680

[22] Filed: May 29, 1991 (Under 37 CFR 1.47)

[51] Int. Cl.[6] ..... G01L 1/00

[52] U.S. Cl. ..... 73/802

[58] Field of Search ..... 73/760, 789, 791, 802

*Primary Examiner*—Stephen C. Bentley

*Assistant Examiner*—Christopher K. Montgomery

*Attorney, Agent, or Firm*—John P. Tarlano; Darrell E. Hollis

[57] ABSTRACT

A method of determining the effects of stress on a non-linear orthotropic missile structure. Measurements of non-linear orthotropic strain, due to step-wise increasing stress in one of three orthogonal directions, are made. Non-linear orthotropic strain terms of the missile structure, in each of three orthogonal directions, are determined from the measurements. A compliance matrix is formed by using the determined strain terms. This compliance matrix is used in an iterative fashion of step-wise increasing stress, to determine three dimensional strain of the missile structure.

3 Claims, 3 Drawing Sheets

$$[S] = \begin{bmatrix} \frac{1}{E_{aa}} & \frac{-\nu_{ab}}{E_{aa}} & \frac{-\nu_{ac}}{E_{aa}} & 0 \\ \frac{-\nu_{ba}}{E_{bb}} & \frac{1}{E_{bb}} & \frac{-\nu_{bc}}{E_{bb}} & 0 \\ \frac{-\nu_{ca}}{E_{cc}} & \frac{-\nu_{cb}}{E_{cc}} & \frac{1}{E_{cc}} & 0 \\ 0 & 0 & 0 & \frac{1}{G_{ab}} \end{bmatrix}$$

FIG. 1

$$[s] = \begin{bmatrix} \frac{1}{E_{aa}} & \frac{-\nu_{ab}}{E_{aa}} & \frac{-\nu_{ac}}{E_{aa}} & 0 \\ \frac{-\nu_{ba}}{E_{bb}} & \frac{1}{E_{bb}} & \frac{-\nu_{bc}}{E_{bb}} & 0 \\ \frac{-\nu_{ca}}{E_{cc}} & \frac{-\nu_{cb}}{E_{cc}} & \frac{1}{E_{cc}} & 0 \\ 0 & 0 & 0 & \frac{1}{G_{ab}} \end{bmatrix}$$

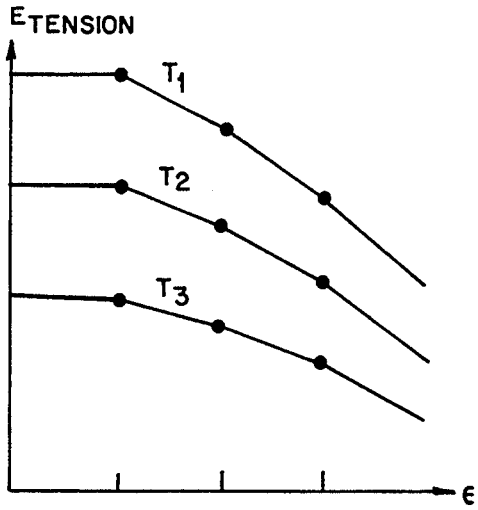

FIG. 2

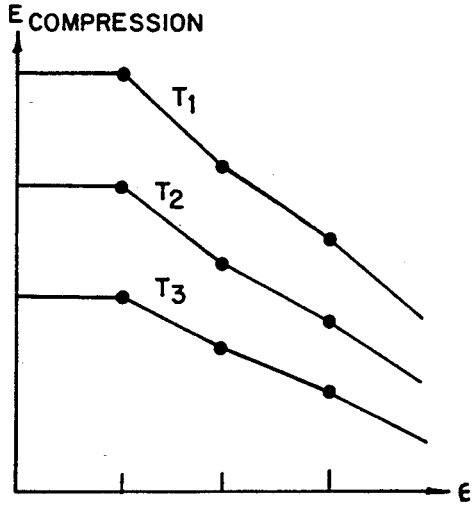

FIG. 3

FIG. 4

$$[s] = \begin{bmatrix} \frac{1}{E_{11}} & \frac{-\nu_{12}}{E_{11}} & \frac{-\nu_{13}}{E_{11}} & 0 & 0 & 0 \\ \frac{-\nu_{21}}{E_{22}} & \frac{1}{E_{22}} & \frac{-\nu_{23}}{E_{22}} & 0 & 0 & 0 \\ \frac{-\nu_{31}}{E_{33}} & \frac{-\nu_{32}}{E_{33}} & \frac{1}{E_{33}} & 0 & 0 & 0 \\ 0 & 0 & 0 & \frac{1}{G_{21}} & 0 & 0 \\ 0 & 0 & 0 & & \frac{1}{G_{13}} & 0 \\ 0 & 0 & 0 & 0 & 0 & \frac{1}{G_{23}} \end{bmatrix}$$

METHOD FOR DETERMINING THE EFFECTS OF STRESS

BACKGROUND OF THE INVENTION

1. Field of the Invention

The present invention relates to a method for determining the effects of stress on a non-linear orthotropic missile structure. The method uses three dimensional non-axisymmetric stresses and resultant strains, margins of safety, displacements, rotations, and internal loads, and bending moments. The method takes into account unequal tension and compression properties of materials, as well as non-linear properties of material and non-linear geometric displacements.

2. Description of Prior Art

Previous methods use mathematical models for calculating behavior of missile surfaces under stress. Those mathematical models do not include three dimensional non-linear orthotropic terms. An orthotropic missile structure is a missile structure that has special elastic properties. These elastic properties have considerable variation in two or more directions that are perpendicular to one another.

Thus a structural analysis method of the prior art, when using such a prior art mathematical model, would not accurately provide the true behavior of a missile structure to stress in three dimensions.

A method of more accurately predicting the three dimensional behavior of a missile structure to stresses is disclosed. The method uses a mathematical model of the missile structure. The mathematical model contains three dimensional non-linear orthotropic terms. With the new method an improved representation of the behavior of a missile structure may be obtained. In addition, the effects of changing temperature can be included in the method.

The present method has been developed for the structural analysis of rocket motor chambers, and similar structures such as rocket nozzles. During service use, these structures are subjected to non-axisymmetric, very general, and complex loading conditions. Such structures are constructed of nonlinear orthotropic materials. The model was developed with extended capabilities, not general available in existing computer codes. Specifically, the present method is capable of solving problems with any or all of the following characteristics:

1. Structures that are not axisymmetric, such as motor chambers with local non-axisymmetric imperfections (manufacturing anomalies or service damage). The mathematical model does not require idealization of a problem into a 2D problem.
2. The structure may be manufactured from orthotropic non-linear materials. The present method has special orthotropic non-linear capabilities. It is not limited to orthotropic linear structures.
3. The material may have different properties in tension and compression. The present method accounts for different tension/compression material properties.
4. The present method is designed to handle large problems efficiently. There is no limitation on a number of elements or nodes. The method is easily portable to take full advantage of resources of large computers.
5. Structure may be subjected to arbitrary loads.

6. Buckling loads may be predicted with the program.

The method can analyze a rocket motor that has the following unique characteristics. Such characteristics complicate the structural analysis:

1. The rocket chamber is constructed of multiple plies of filament winding. The fibers in the layers are in different directions. The fibers are the load resisting members. There are circumferential plies to resist hoop loads. There are polar plies to resist axial loads. A continuum code is required to predict accurately interlaminar shear stresses and normal stresses between the layers and stress concentrations due to non-axisymmetric flaws.
2. The chamber material is orthotropic because the fiber modulus is extremely high relative to the resin modulus. The mechanical properties can be sizably different in the three principal material directions. The shear and compression properties of typical chamber material are sizably non-linear. This necessitates use of a method that can handle non-linear orthotropic material properties.
3. The motor material properties are sizable different in tension from compression. Test data indicates certain nozzle materials may exhibit at elevated temperature tension properties which are different from compression by a factor of 20. This necessitates a code which accurately accounts for this difference in tension/compression properties.
4. The chamber can have manufacturing anomalies and/or service damage which are not axisymmetric. This necessitates a code capable of handling 3D geometries.
5. The chamber and nozzle are typically subjected to non-axisymmetric loads, including concentrated loads due to surge, mechanical fasteners and attachments, actuators, etc.
6. The chamber must be designed to resist buckling, and to maintain positive margins of safety with respect to strength.
7. The chamber is a pressure vessel and must be designed to sustain internal pressure loads.

In order to address the problem described above, it is necessary to utilize a theory which incorporates an incremental formulation to model complex path-dependent, non-linear material behavior.

The structural problems at which the present method is aimed are highly nonlinear due to both geometric and material nonlinearities. To handle these nonlinearities, the equilibrium equations are formulated in an incremental format.

The 3D motor geometry is idealized with isoparametric continuum elements which are able interlaminar normal and shear stresses. The use of 3D elements permits modelling of flaws and non-axisymmetric geometries. The element is described in Section 3.

The material properties are permitted to be non-linear with different tension/compression mechanical properties. The properties are described by piecewise linear functions of strain. No assumptions are made with regard to the properties having identical ratios of modulus slope in all 3 directions and shear. These are permitted to be arbitrary, and are permitted to conform exactly to the test data. No restrictions are made with regard to the number of piece-wise linear segments used to described the tension, compression and shear properties as a function of strain.

The response of the structure to load is non-linear because of possible large deformations, and the non-linear behavior of the material. Consequently, the load must be applied in increments and the solution obtained by iteration at each load step. The incremental procedure allows one to predict accurately path-dependent material behavior and buckling loads which is not possible with deformation type codes.

DESCRIPTION OF THE DRAWINGS

FIG. 1 is a two dimensional compliance matrix.

FIGS. 2 and 3 are graphs of diagrams of data produced as a part of the present invention.

FIG. 4 is a compliance matrix for the present invention.

DESCRIPTION OF THE PREFERRED EMBODIMENT

Figure 5:
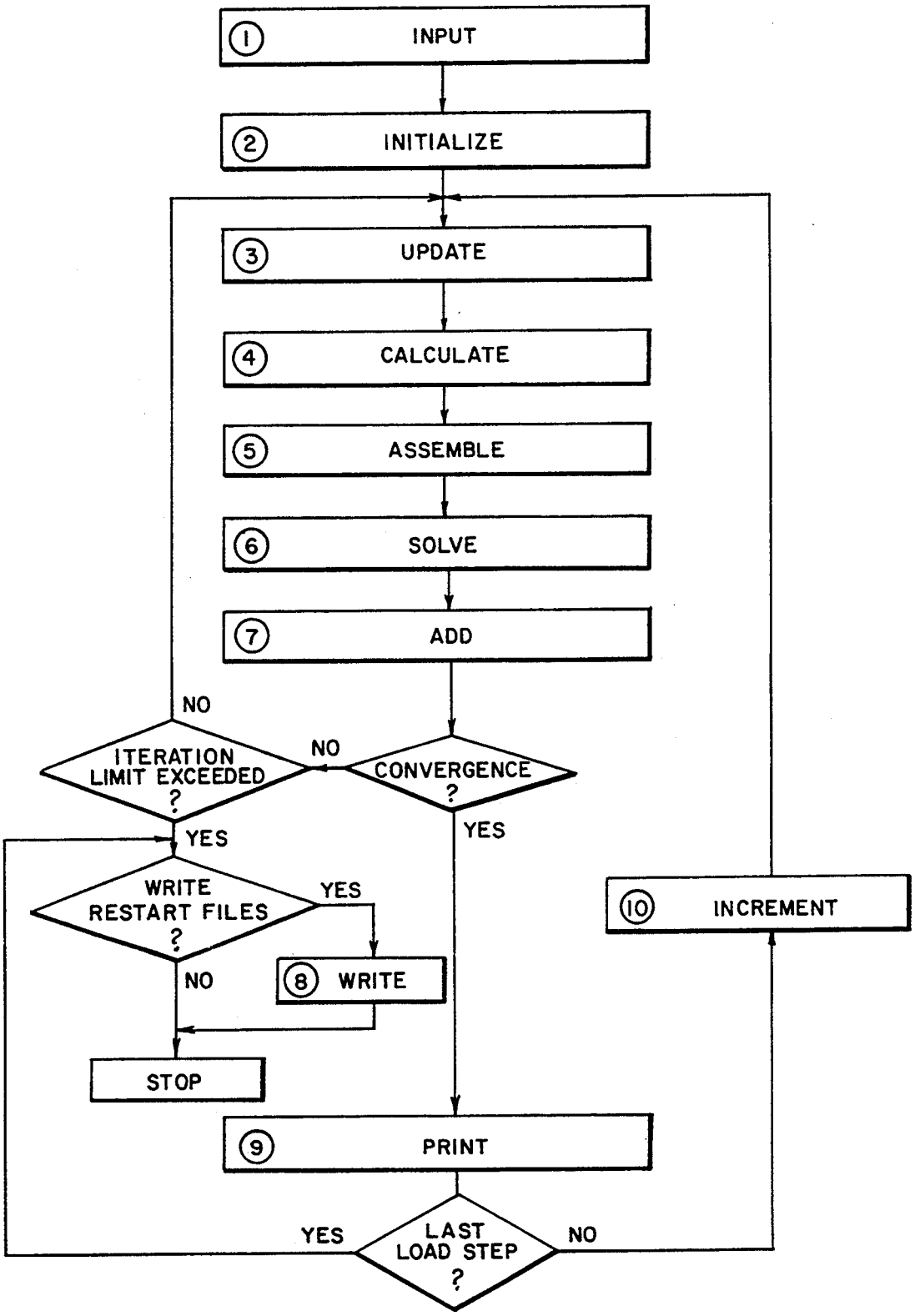
FIG. 5 is a code flow chart for an iteration process.

In developing the method, two new material models were developed for treating nonlinear orthotropic materials. The new nonlinear orthotropic material models allow for unequal tension/compression properties that may be functions of strain and temperature. The nonlinear stress-strain curve is represented by a multi-piecewise nonlinear curve. In addition to the new models several other models are available in the program. These include linear isotropic, linear orthotropic, inelastic metal plasticity, and non-linear elastic incompressible.

The theoretical details of each material model are given. For each model, it is necessary to provide the incremental stress-strain relationship in global coordinates. These are required to complete the incremental formulation of the equilibrium equations described in the following pages.

Nonlinear Orthotropic (2D)

Linear orthotropic theory will be reviewed before presenting details of the nonlinear orthotropic model. For a two dimensional axisymmetric problem, a linear orthotropic material is defined in terms of 7 independent engineering constants such that $$\begin{bmatrix} \epsilon_{aa} \\ \epsilon_{bb} \\ \epsilon_{cc} \\ \epsilon_{ab} \end{bmatrix} = \begin{bmatrix} S_{11} & S_{12} & S_{13} & 0 \\ S_{21} & S_{22} & S_{23} & 0 \\ S_{31} & S_{32} & S_{33} & 0 \\ 0 & 0 & 0 & S_{44} \end{bmatrix} \begin{bmatrix} \sigma_{aa} \\ \sigma_{bb} \\ \sigma_{cc} \\ \sigma_{ab} \end{bmatrix}$$

where $[\epsilon]$=Strain vector.

$[\sigma]$=Stress vector.

[S]=Linear compliance matrix, or stiffness matrix.

The compliance matrix [S] may be written in terms of 7 engineering constants. The compliance matrix [S] is expressed in FIG. 1.

For the matrix shown in FIG. 1, a, b, c, are principal material directions. The material constants are the 3 Young's moduli in the principal material directions ($E_{aa}$, $E_{bb}$, $E_{cc}$), the 3 Poissons ratios ($\nu_{ab}$, $\nu_{ac}$, $\nu_{bc}$) and the shear modulus in the a–b plane ($G_{ab}$). The Poissons ratios are defined by $$\nu_{ij} = -(\epsilon_{jj})/(\epsilon_{ii}) \text{ for } \sigma_{ii} \text{ applied}$$

and the material constants are related by $$(\nu_{ij})/(E_{ii}) = (\nu_{ji})/(E_{jj})$$

In the above two relations, i and j take on values of a, b, or c.

In the present formulation, the "c" axis is taken to be in the circumferential or hoop direction. (The hoop is a principal material direction). The above relation may be inverted to obtain a stress-strain relation, e.g.

$$[\sigma]=[C][\epsilon]$$

where [C] is equal to the inverse of the [S] matrix, e.g.

$$[C]=[S]^{-1}$$

The matrix [C] is usually called the material stiffness matrix.

In linear theory, the 7 material properties, or terms as described above, are assumed to be true constants. However, in nonlinear theory, incremental material constants, which represent material properties, may be functions of strain and/or temperature, and may have different values in tension and compression, as shown in FIGS. 2 and 3. Each incremental material constant, in tension and compression, is represented by a set of piece-wise linear functions of strain for each temperature. As the number of strain and temperature points in the curve is not limited, these curves can be as detailed as desired. In FIGS. 2 and 3, E represents Young's modulus of elasticity (psi) and represents strain.

A computer program increments the load and iterates on the solution. For a given load and temperature, the solution algorithm solves for the displacements and hence the strain. Once this strain is known, appropriate incremental material constants may be found from the input nonlinear stress-strain data using either tensile or compressive properties. Using these properties, the compliance matrix or stiffness matrix, in material directions may be obtained using the above definitions.

For a 3D nonlinear orthotropic material model 9 material constants are required to define compliance: three Young's moduli, three Poisson's ratios and three shear moduli in principal material directions. Defining the principal material axes as (1, 2, 3), a compliance matrix can be written, as shown in FIG. 4.

The incremental material constants are in the material principal directions. .These incremental material constants are permitted to be different in tension and compression, and are described by multiple piece-wise linear curves as shown in FIGS. 2 and 3. The tables of input incremental material constants are used by the program to select the correct tension and/or compression material properties at the strain corresponding to the current load during the incremental and iterational procedure.

The governing equation of equilibrium, given by the equation below, is nonlinear due both geometric (displacement) and material nonlinearities, both of which have been included in the formulation.

At each load step, the nonlinear equation must be solved by an iterative procedure, such as by Newton's method. Newton's method has been disclosed in the literature. The algorithm in the present program uses a modified Newton's method. On the first iteration, the tangent stiffness matrix is updated, based on current displacements, stresses and strains. The stiffness matrix is then held constant during the remaining iterations for that load step. During each iteration, however, incremental material constants are updated in all stress and compliance calculations. The iterations and incremental material constant-updating-algorithm are described below.

FIG. 5 depicts the overall incremental and iterational algorithm used-by the program. As stated previously, the program is incremental in nature and obtains a converged solution at each increment of load. As opposed to deformation type codes, this allows the correct solution of path dependent problems. The input module processes the necessary input such as nodal coordinates, element connectivity, material properties, external loading and temperature applied to the structure.

For the first increment of load, the program then calculates the necessary element stiffness and force matrices using material constants at the current strain and temperature. For the first step and first iteration, the material constants used are assumed to be in tension, and correspond to zero strain and the initial starting temperature. The element stiffness and force matrices are assembled to form the global matrices. The incremental equation of equilibrium, given by the following equation, is then solved for the displacement increments at each node:

$$([S_L]+[S_{NL}])\{\Delta u\}=\{R^{s+\Delta s}\}-\{F^s\}$$

where $[S_L]$=Linear stiffness matrix $[S_{NL}$9 32 Non-linear stiffness matrix

[R]=Vector of applied loads $\{R^{s+\Delta s}\}$=Vector of applied loads at load s+Δs {F}=Vector of forces due to internal stresses $\{F^s\}$=Vector of internal forces due to internal stresses, at load s {Δu}=Displacement increment vector from load s to load s+Δs.

The solution procedure used is based on an active column or skyline format in conjunction with a Gaussian elimination scheme. Both in core and out of core solution procedures are utilized. The number of degrees of freedom is essentially unlimited when the out of core equation solver is utilized. The displacement increments, just determined, are added to the displacements at the beginning of the load step to form the first estimate of the displacement for the current load step. The solution is then checked for convergence, and if convergence has not occurred, the incremental material constants are updated to the current strain and appropriate incremental tension or compression constants are selected.

The updating of the incremental material constants is described further in the next section. Once the incremental material constants are updated, the international loop is repeated, and the equations of equilibrium are again solved. In the second and succeeding iterations, the algorithm is essentially a Newton iteration and consequently the displacement increments being solved for, are actually corrections to the previous displacements obtained. These corrections are added to the previous displacement solution to obtain a new estimate, and convergence is again checked.

When convergence has been achieved, the strains and stresses are computed, and along with displacements, are printed for current load step. The load and temperature are then incremented, and the procedure is repeated for the next load step.

The incremental procedure utilized herein allows one to trace out a complete load-displacement history. Consequently, path-dependence, as might be caused by non-linear material constants, or geometric non-linearities, or imperfections, is properly accounted for. Furthermore, bucking during the presence of large deformations may be determined.

Figure 6:
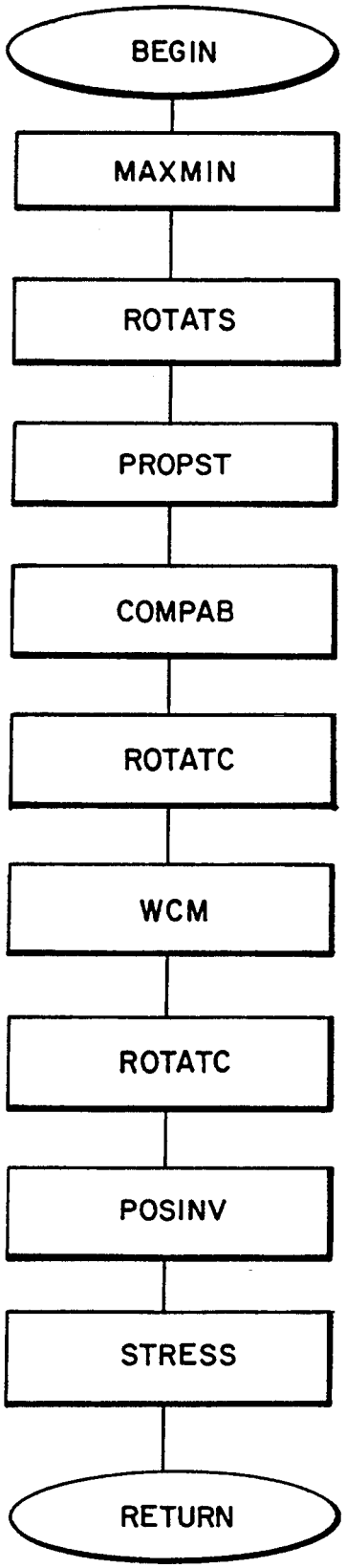
FIG. 6 is a block diagram of new 2D routines.

This section describes a collection of nine subroutines which update incremental material constants and select appropriate incremental tension and/or compression constants for the current strain and/or temperature. The eight subroutines shown in FIG. 6 are called from a 9th subroutine which acts as a driving routine to carry out the necessary steps outlined in FIG. 6. The input to this collection of subroutines consists of the displacements for all degrees of freedom and the corresponding stresses and strains for all element iteration points, based upon inremental material constants at the previous iteration. The first subroutine MAXMIN takes the input stresses in global directions and computes the principal stresses and their directions.

The next subroutine ROTATS transforms the strains in global directions to principal material directions. The subroutine PROPST obtains tension and compression incremental material constants in principal material directions, at the current strain and temperature. These incremental material constants are extracted from the input data read into the program.

In subroutine COMPAB, the tension and compression incremental material constants, determined by subroutine PROPST, are used to obtain tension and compression compliances in principal material directions. That is, compliances matrices, of the form shown in FIG. 1 or FIG. 4, are formed for both tension and compression incremental material constants. Subroutine ROTATC is then used to transform these tension and compression compliance matrices from principal material directions to principal stress directions. Recall that the principal stress directions were obtained by subroutine MAXMIN. Subroutine WCM obtains a weighted compliance in principal stress directions. This algorithm uses these magnitudes and signs of the principal stresses to assign either tension or compression incremental material constants to the compliance terms. If the principal stresses are all positive, then tension compliance type incremental material constants are selected. If the principal stresses are all negative, then compressive compliance type incremental material constants are utilized. If the principal stresses are mixed, e.g. tension and compression, then a weighted average of tension and compression compliance type incremental material constants are taken. Utilizing the weighted compliance obtained in subroutine WCM, subroutine ROTATC transforms this compliance from principal stress direction to global direction.

The compliance matrix is then inverted by subroutine POSINV to obtain the stiffness matrix in global direction. Utilizing this stiffness matrix, which has now been updated to the current strain and temperature, and which has been updated to contain tension or compression incremental material constants at the particular iteration point, a new set of stresses is computed in subroutine STRESS. These stresses are then used in the calculations shown in FIG. (5) to recompute new stiffness matrices and new internal stress matrices defined previously. The iteration loop described in the previous section and shown in FIG. 5 is entered once more. The solution of the equations of equilibrium once more provides new displacement which are then used to calculate new stresses and strains, which are in turn utilized to update incremental material constants, according to the procedure just described.

It should be noted that the updating of incremental material constants occurs for each iteration point within the element. This corresponds to a minimum of four iteration points for the 2D axi-symmetric elements, and 27 points for the 3D elements. This allows for accurate selection of appropriate material properties for many points within the element, and accounts properly for the distribution of different stresses, and consequently incremental material constants throughout the element.

The steps shown in FIG. 5 are described as follows:

1. INPUT necessary information including nodal coordinates, element connectivity, incremental material constants as function of strain and temperature, pressures and forces applied, boundary conditions, and various solution control parameters.
2. INITIALIZE displacements, strains and stresses to zero. If restarting, read these from restart files. Initialize loads to first increment. Initialize incremental material constants.
3. UPDATE incremental material constants. See FIG. 6.
4. CALCULATE necessary element stiffness and force matrices (using incremental material constants at current strain and temperature)

$$[S_L] = \int_{VOL} [B_L]^T [C] [B_L] \, dV$$

5. ASSEMBLE all element matrices to form global, incremental equations of equilibrium. Apply displacement boundary conditions.
6. SOLVE incremental equations of equilibrium for the displacement increments(using Gaussia elimination).
7. ADD displacement increments to displacements at beginning of step.
8. WRITE restart files.
9. PRINT displacements. Calculate strains and stresses and print.
10. INCREMENT load and temperature to next step.

While the present invention has been disclosed in connection with the preferred embodiment thereof, it should be understood that there may be other embodiments which fall within the spirit and scope of the invention as defined by the following claims.

What is claimed is:

1. A method of determining the effects of stress on a non-linear orthotropic missile structure, comprising:

(a) measuring three dimensional non-linear orthotropic strains of a non-linear orthotropic missile structure due to mechanical series of stresses on the missile structure;

(b) determining three dimensional non-linear orthotropic strain terms from the measurements;

(c) forming a compliance matrix from the strain terms, and (d) multiplying the compliance matrix by a stress vector, in order to determine a strain vector, the strain vector being an indication of the behavior of the non-linear orthotropic missile structure to a given stress.

2. A method of determining the effects of stress on a non-linear orthotropic missile structure at a given temperature, comprising:

(a) measuring three dimensional non-linear orthotropic strains of a non-linear orthotropic missile structure due to a mechanical series of stresses on the structure, while the missile structure is at a series of temperatures;

(b) determining three dimensional non-linear orthotropic strain terms from the measurements;

(c) forming a compliance matrix from the strain terms; and (d) multiplying the compliance matrix by a stress vector, while using a given temperature for the compliance matrix, in order to determine a strain vector, the strain vector being an indication of the behavior of the non-linear orthotropic missile structure to a given stress at a given temperature.

3. The method of claim 2 wherein said matrix is formed at an incremental step of strain and said multiplying step is performed.

* * * * *